US005559423A

United States Patent [19]

Harman

[11] Patent Number: 5,559,423

[45] Date of Patent: Sep. 24, 1996

[54] VOLTAGE REGULATOR INCLUDING A LINEAR TRANSCONDUCTANCE AMPLIFIER

[75] Inventor: Stephen G. Harman, Nepean, Canada

[73] Assignee: Norhtern Telecom Limited, Montreal, Canada

[21] Appl. No.: 220,651

[22] Filed: Mar. 31, 1994

[51] Int. Cl.[6] ..... G05F 1/565

[52] U.S. Cl. ..... 323/277; 323/280

[58] Field of Search ..... 323/266, 273, 323/277, 278, 279, 280, 908, 282, 303; 363/89

[56] References Cited

U.S. PATENT DOCUMENTS

| | | | |
|---|---|---|---|
| 4,358,728 | 11/1982 | Hashimoto | 323/275 |
| 4,618,813 | 10/1986 | Vesce et al. | 323/268 |
| 4,727,261 | 2/1988 | Fairchild | 307/10 |
| 4,733,159 | 3/1988 | Edwards et al. | 323/282 |
| 4,786,822 | 11/1988 | Steely | 307/125 |
| 4,980,576 | 12/1990 | Rossi et al. | 307/270 |
| 5,038,266 | 8/1991 | Callen et al. | 363/89 |
| 5,043,686 | 8/1991 | Plunkett | 333/181 |
| 5,051,613 | 9/1991 | Houser, Jr. et al. | 307/296.3 |
| 5,103,157 | 4/1992 | Wright | 323/257 |
| 5,191,278 | 3/1993 | Carpenter | 323/275 |
| 5,212,456 | 5/1993 | Kovalcik et al. | 330/261 |
| 5,373,255 | 12/1994 | Poletto et al. | 323/282 |
| 5,412,309 | 5/1995 | Ueunten | 323/316 |
| 5,424,932 | 6/1995 | Inou et al. | 363/21 |

FOREIGN PATENT DOCUMENTS

| | | |
|---|---|---|
| 0274951 | 7/1988 | European Pat. Off. . |
| 2140996 | 12/1984 | United Kingdom . |
| 2182788 | 5/1987 | United Kingdom . |

OTHER PUBLICATIONS

F. Goodenough, "Tiny IC Plus FET Builds 'Super LDO' Regulator", Electronic Design, vol. 42, No. 5, Mar. 7, 1994, pp. 45–49.

Description of MAX 436 wideband transconductance amplifier, Maxim Integrated Products Inc., 19–0042, Sep. 92, pp. 1–14.

*Primary Examiner*—Peter S. Wong
*Assistant Examiner*—Adolf Berhane
*Attorney, Agent, or Firm*—R. John Haley

[57] ABSTRACT

A voltage regulator for an electronic circuit card includes a FET with a source supplied via an input LC filter with a voltage to be regulated, a drain for delivering a regulated output voltage via a current-sensing resistor and an output LC circuit, and a gate which is supplied with a current drive from a linear transconductance amplifier having a differential input responsive to the regulated output voltage relative to a reference voltage. The regulator provides large bandwidth low voltage drop regulation without requiring higher voltage supply for the gate of the FET. A current limiting circuit reduces the current drive in response to excessive current through the current-sensing resistor, and a turn-on control circuit reduces the current drive to provide a controlled turn-on for hot insertion of the card into electronic equipment.

13 Claims, 2 Drawing Sheets

VOLTAGE REGULATOR INCLUDING A LINEAR TRANSCONDUCTANCE AMPLIFIER

This invention relates to voltage regulators, and is particularly concerned with a voltage regulator using a field effect transistor (FET) as a regulating device to provide a low voltage drop and large bandwidth rejection of transients and noise on a voltage supply line, which is particularly suitable for use on circuit cards in communications equipment.

BACKGROUND OF THE INVENTION

It is well known in communications equipment to provide circuit cards which can be inserted into and removed from shelves of an equipment rack, the insertion of a card establishing electrical connections thereto and these connections being broken on removal of the card. The connections include connections to power supply lines from a power supply unit of the equipment shelf or rack. Each card can include voltage regulators for regulating voltages derived from the power supply lines to levels desired for operation of electronic circuits on the card. It is desirable that the voltage drop, and consequent power loss, involved in the voltage regulation be as small as possible.

In order to permit continued operation of other cards of the equipment while a card is inserted or removed, it is desirable to permit so-called hot insertion and removal of cards, i.e. insertion and removal of a card during operation of the equipment with the power supply unit active and the power supply lines at their normal operating voltages. However, hot insertion or removal of a card presents a sudden increase or decrease, respectively, in the load connected to the power supply lines, which in turn results in transients on the power supply lines. The severity of transients which occur on hot insertion of a card can be reduced by providing a controlled turn-on of the load presented by the card. Transients which occur on hot removal of a card can not be reduced in practice in a similar manner.

These transients can cause faulty operation (so-called hits) in already operating cards, unless the transients are filtered out by the voltage regulators on the cards. As the transients include high frequency components, effective filtering by a voltage regulator requires that this have an all-stop frequency characteristic over a large bandwidth, for example of the order of 1.5 MHz. The filtering effect of the voltage regulators is also reduced with reduced regulator voltage drop, so that a compromise must be made between filtering and power loss.

It is well known to provide a voltage regulator in which a FET is used as the voltage regulating device. Typically, for a positive supply voltage an enhancement mode N-channel power MOS (metal-oxide-semiconductor) FET is used with its drain connected to the positive supply voltage and its source connected to the load. This is a common-drain or source-follower arrangement in which the output voltage supplied from the source to the load is determined by the voltage supplied to the gate of the FET. Operation of such an arrangement with a low drain-source voltage drop requires that the gate be supplied with a positive voltage greater than the positive supply voltage, necessitating the provision of an additional voltage supply line (which is itself subject to transients) or additional circuitry such as a voltage multiplier driven by a charge pump. Thus this arrangement, and its converse using a P-channel FET for a negative supply voltage, has disadvantages.

An alternative arrangement for a positive supply voltage is to use a P-channel FET with its source connected to the positive supply voltage and its drain connected to the load. This is a common-source arrangement which avoids the above disadvantage in that the gate can be supplied with a control voltage which is between the positive supply voltage and ground (to which the other side of the load is connected). However, voltage gain of the FET in this arrangement makes control of the FET more difficult.

More significantly, in this arrangement the apparent gate capacitance of the FET is considerably increased (being equivalent to the gate-source capacitance in parallel with the gate-drain capacitance multiplied by the voltage gain plus one), and this with the parasitic gate resistance results in a pole at a frequency typically of the order of 1 MHz (determined by $\frac{1}{2}\pi RC$, where R is the parasitic gate resistance, typically about 7.5 Ω, and C is the apparent gate capacitance, typically about 22 nF). The control voltage for the gate of the FET is produced by a voltage comparison and feedback circuit which includes an integrating function, defining another pole of the control loop. For stability, especially in view of variations among FETs, this other pole must be at a frequency not more than about one-tenth of the gate capacitance-resistance pole frequency, and hence must be of the order of 100 kHz or less. The bandwidth of the control loop is thus limited to the order of 100 kHz, which is much less than is required.

It is also known to use a switching regulator to achieve voltage regulation, in which a FET is rapidly switched between saturated on and off states in a pulse width modulated manner. In this case the output of the FET is a switched voltage which must be subjected to smoothing and filtering to remove residual components at the switching frequency. Typically, such a switching regulator may be used in the equipment power supply unit to supply power to the power supply lines for distribution among the circuit cards as discussed above. The switching frequency can for example be of the order of 300 kHz, this being within the 1.5 MHz bandwidth desired of the voltage regulators on the circuit cards.

An object of this invention is to provide a voltage regulator which can provide an all-stop frequency characteristic over a large bandwidth with a low voltage drop without the disadvantages of the prior art as discussed above.

SUMMARY OF THE INVENTION

According to one aspect of this invention there is provided a voltage regulator comprising a FET having a source coupled to an input terminal for a voltage to be regulated, a drain coupled to an output terminal for a regulated output voltage, and a gate, and a linear transconductance amplifier responsive to the output voltage for supplying a current drive to the gate of the FET.

This provides a common-source configuration of the FET which avoids the need for a separate or voltage-multiplied supply for the gate of the FET. The use of the linear transconductance amplifier to provide a current drive to the gate of the FET creates an ideal integrator from the current drive and the gate capacitance, the control loop thereby having only a single pole which is unconditionally stable and readily determines a large bandwidth of the control loop.

The voltage regulator conveniently includes a potential divider coupled to the output terminal, the transconductance amplifier having differential inputs coupled to a tapping point of the potential divider and to a reference voltage.

According to another aspect this invention provides a voltage regulator comprising: an input terminal for receiving an input voltage to be regulated; an output terminal for delivering a regulated output voltage; a FET having a source coupled to the input terminal, a drain coupled to the output terminal, and a gate; and a linear transconductance amplifier having differential input terminals responsive to the output voltage and a reference voltage and an output coupled to the gate of the FET for supplying current thereto.

The voltage regulator preferably includes an input low-pass filter comprising a series inductor, via which the source of the FET is coupled to the input terminal, and a shunt capacitor, and an output low-pass filter comprising a series inductor, via which the drain of the FET is coupled to the output terminal, and a shunt capacitor, the inductor of the output low-pass filter having a greater inductance than the inductor of the input low-pass filter.

Advantageously the voltage regulator can include a current-sensing resistor via which the drain of the FET is coupled to the output low-pass filter, and a current limiting circuit responsive to an excessive current flow through the current-sensing resistor for reducing current drive from the transconductance amplifier to the gate of the FET. The voltage regulator can also include a turn-on control circuit responsive to initial supply of voltage to the input terminal for reducing current drive from the transconductance amplifier to the gate of the FET.

According to a further aspect, the invention provides a voltage regulator comprising a common-source voltage regulating FET and a feedback control path comprising a voltage-controlled current source having an output coupled to a gate of the FET.

Preferably the voltage-controlled current source comprises a linear transconductance amplifier, or an amplifier without negative feedback, and a control loop formed by the feedback control path and the voltage regulating FET has a dominant pole determined by an apparent gate capacitance of the FET and the current source.

The invention also extends to an electronic circuit card including two voltage regulators each as recited above for supplying respectively positive and negative regulated voltages to electronic circuits on the circuit card.

BRIEF DESCRIPTION OF THE DRAWINGS

The invention will be further understood from the following description with reference to the accompanying drawings, in which.

DETAILED DESCRIPTION

Figure 1:
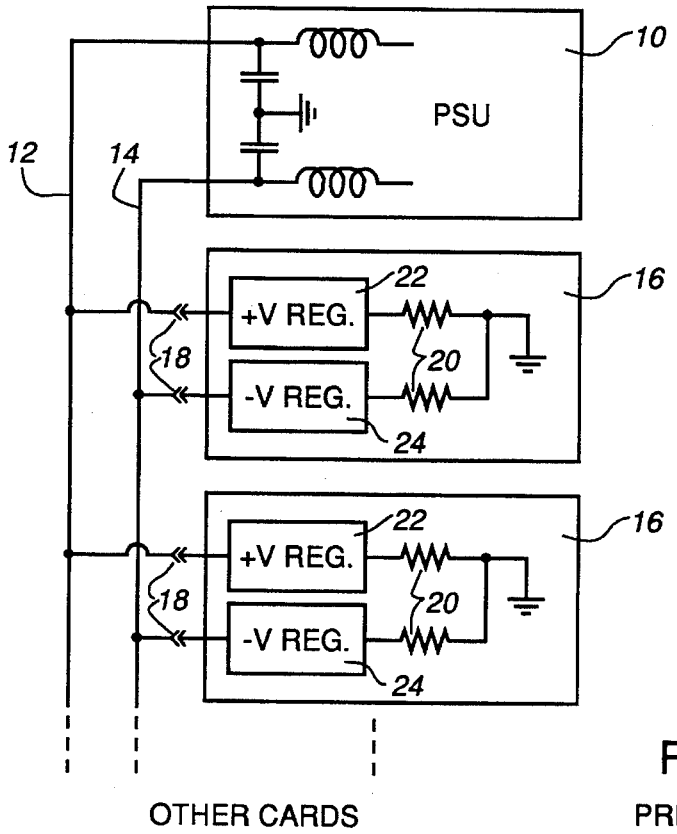
Fig. 1 PRIOR ART
FIG. 1 schematically illustrates a known arrangement of electronic equipment including printed circuit cards.

Referring to FIG. 1, electronic equipment, for example for communications, includes a power supply unit (PSU) 10 which delivers positive and negative supply voltages to supply voltage lines 12 and 14, respectively, via LC (inductive-capacitive) output circuits. Circuit cards 16 of the equipment, only two of which are shown for simplicity, can be inserted into and removed from the equipment, being connected to the supply voltage lines 12 and 14 via connectors 18. For simplicity other connections to the cards 16, for example for signal and ground paths, are not shown in FIG. 1. Each card 16 includes circuits represented by loads 20, and positive and negative voltage regulators (+V REG. and −V REG.) 22 and 24 via which the circuits on the card are supplied with power from the PSU 10 via the lines 12 and 14 respectively.

As discussed above, each voltage regulator 22 or 24 must provide a low voltage drop to achieve low power loss, and an all-stop filter frequency characteristic so that hot insertion and removal of any card 16, and consequent making and breaking of connections via the connectors 18 to connect and disconnect the loads 20, does not adversely affect operation of any of the other cards 16 due to transients on the supply voltage lines 12 and 14.

Figure 3:
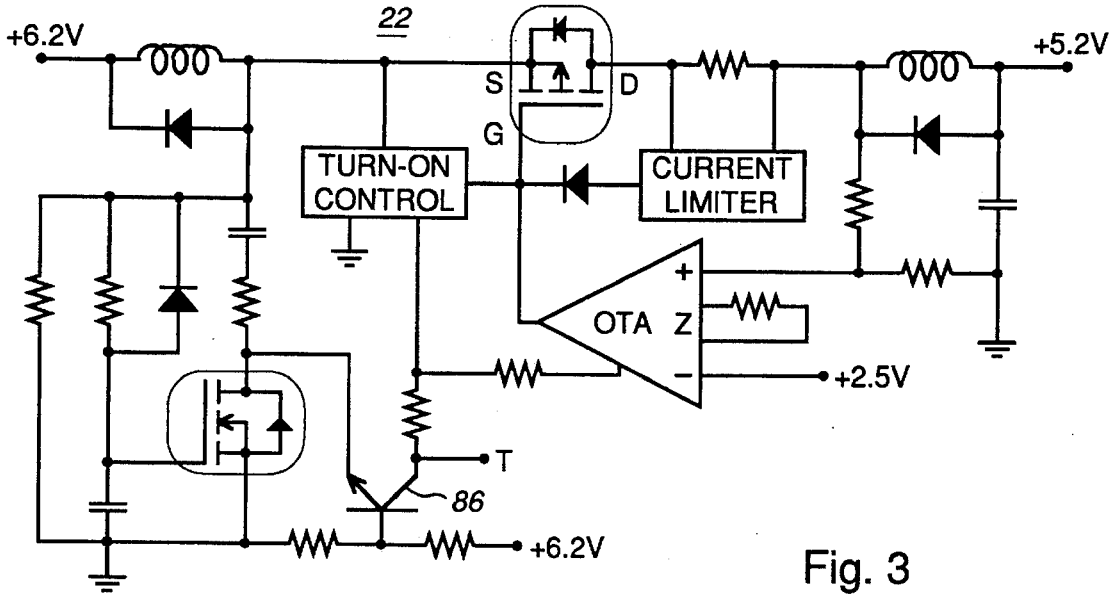
FIGS. 2 and 3 illustrate voltage regulators in accordance with this invention.
Figure 2:
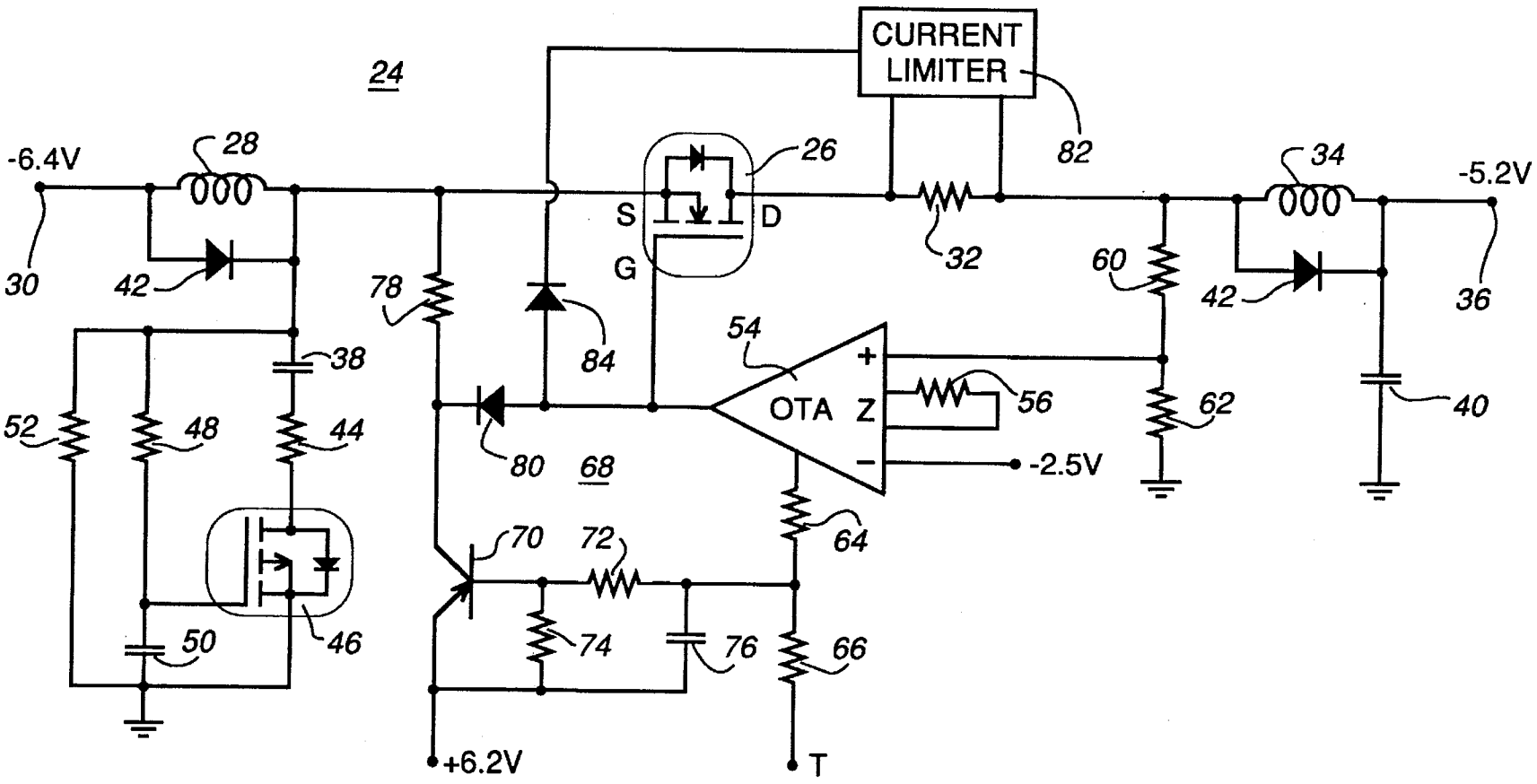

By way of example, it is assumed in the following description that the PSU 10 is a switching regulator having a switching frequency of 320 kHz and providing a voltage of +6.2 V on the line 12 and a voltage of −6.4 V on the line 14, and that the voltage regulators 22 and 24 deliver regulated voltages of +5.2 V and −5.2 V respectively, each at a current up to 3A. FIG. 2 illustrates the form of each negative voltage regulator 24, and FIG. 3 illustrates the complementary form of each positive voltage regulator 22.

Referring now to FIG. 2, the negative voltage regulator 24 includes an N-channel power MOS FET 26 having a gate G, a source S coupled via an inductor 28 to an input terminal 30 for the −6.4 V supply from the line 12, and a drain D coupled via a series current-sensing resistor 32 and an inductor 34 to an output terminal 36 at which the voltage regulator produces the regulated −5.2 V supply for the load 20.

The inductors 28 and 34 form input and output LC low-pass filter or smoothing circuits with respective shunt capacitors 38 and 40, with reverse-biassed diodes 42 connected in parallel with the inductors in known manner. The input LC circuit is controlled by a time switch including a current-limiting resistor 44 and drain-source path of a P-channel MOS FET 46 in series with the capacitor 38, and an RC circuit comprising a resistor 48 in series with a capacitor 50 with their junction connected to the gate of the FET 46. The time switch provides a delay of a few milliseconds after hot insertion of the circuit card 16 before the source of the FET 26 reaches the supply voltage of −6.4 V, and reduces transients on the supply voltage line 12 due to hot insertion of the circuit card. A resistor 52 provides a capacitance discharge path on hot removal of the circuit card.

The voltage regulator differs significantly from the prior an in the manner in which the FET 26 is controlled. More specifically, the FET 26 has its gate driven from a current source constituted by the output of an operational transconductance amplifier (OTA) 54 as described further below. A transconductance element is constituted by a resistor 56 connected between input terminals Z of the OTA 54. An inverting (−) input of the OTA 54 is supplied with a stable reference voltage of −2.5 V, and a non-inverting (+) input of the OTA 54 is connected to a tapping point of a potential divider formed by resistors 60 and 62 connected between the output side of the current-sensing resistor 32 and ground. A bias current for the OTA 54 is determined by two resistors 64 and 66 connected in series between a bias current input of the OTA 54 and a terminal T, which is coupled to the positive voltage regulator 22 as described below and is at approximately ground potential in normal operation.

A turn-on control circuit 68 of the negative voltage regulator 24 comprises a PNP transistor 70 having its emitter connected to the +6.2 V supply, its base connected to the tapping point of a potential divider formed by resistors 72 and 74 connected in parallel with a capacitor 76 between the +6.2 V supply and the junction between the resistors 64 and 66, and its collector coupled via a resistor 78 to the source of the FET 26 and via a diode 80 to the gate of the FET 26. On turn-on (hot insertion of the card 16) the transistor 70 is initially non-conductive so that the diode 80 is forward-biassed to conduct current from the output of the OTA 54 so that current to the gate of the FET 26 is reduced. As the capacitor 76 is charged via the resistor 66, the transistor 70 becomes conductive, and a normal operating state is reached in which the diode 80 is reverse-biassed.

A current limiter circuit 82 is responsive to voltage dropped across the current-sensing resistor 32 to render another diode 84, connected between the gate of the FET 26 and an output of the circuit 82, forward-biassed in response to a maximum current of 3A through the resistor 32 being exceeded, thereby providing foldback current limiting. Like the diode 80, the diode 84 is reverse-biassed in normal operation.

Except for opposite polarities and production of the voltage at the terminal T as described below, the positive voltage regulator 22 shown in FIG. 3 is similar to the negative voltage regulator 24 of FIG. 2, and need not be further described. The voltage at the terminal T is produced at the collector of an NPN transistor 86 whose base is connected to the tapping point of a potential divider between the +6.2 V supply (from the line 14) and ground, and whose emitter is coupled to ground via the time switch of the positive voltage regulator as shown in FIG. 3. This arrangement, with appropriate time constants of the respective circuits, permits the positive and negative voltage regulators to be turned on in synchronism or in sequence as required.

The OTA 54 in the voltage regulators of FIGS. 2 and 3 is a linear transconductance amplifier, and for example is a type MAX436 device available from Maxim Integrated Products, Inc., alternatively referred to as a wideband transconductance amplifier. The OTA produces an output current, of either polarity, which is proportional to the differential input voltage between its non-inverting and inverting inputs, with the advantage of not using negative feedback. An alternative OTA device which could instead be used is VTC Inc.'s device type VA2713, which comprises two OTAs in a single package (with buffer amplifiers which are not used in this case) without using a separate transconductance element (i.e. the Z inputs and the resistor 56 in FIG. 2 are omitted) and with the advantage of higher output impedance than the MAX436 device.

By way of example, in the negative voltage regulator 24 of FIG. 2 as described above the following device types and component values can be used for the components identified by their reference numbers:

| | | | |
|---|---|---|---|
| 26 | IRFZ40 | 32 | 0.02 Ω |
| 46 | SI9943DY | 44 | 1.5 Ω |
| 54 | MAX436 | 48 | 200 kΩ |
| 70 | BCX71G | 52 | 47.5 kΩ |
| | | 56 | 332 Ω |
| 28 | 2.15 μH | 60 | 2.162 kΩ |
| 34 | 5 μH | 62 | 2 kΩ |
| | | 64, 66 | 10 kΩ |
| 38, 50 | 1 μF | 72, 74 | 26.7 kΩ |
| 40, 76 | 68 μF | 78 | 4.75 kΩ |

It is observed that the turn-on control circuit 68, comprising the components 70 to 80 as described above, serves to ensure that the control current produced by the OTA 54 has risen on turn-on (hot insertion) to a value greater than the worst-case output leakage current of the FET 26 before the OTA is enabled to control the FET and hence the output voltage of the voltage regulator. With the MAX436 device referred to above, the leakage current can be as high as 100 μA. Using an OTA with a much lower output leakage current, for example up to 100 nA as for the VA2713 device, the turn-on control circuit 68 can be be constituted by a single resistor connected between the source and gate of the FET 26, having a high resistance of for example 400 kΩ, operating in association with the inherent distribution of capacitances at the gate of the FET to provide turn-on control. Whereas such a high resistance can remain in the circuit during normal operation, the relatively low resistance of the resistor 78 as described above, necessary to accommodate a high leakage current, would unacceptably reduce gain and so for normal operation is switched out of the circuit by the transistor 70 and diode 80.

The input LC circuit comprising the components 28, 38, and 44 provides a source impedance for the FET 26 of 1.5 Ω or less at all frequencies, so that the FET 26 operates in a grounded- or common-source mode. The input LC circuit has a relatively low corner frequency less than 100 kHz and a Q-factor of 1. The output LC circuit presents a higher impedance to the drain of the FET 26, due to the higher inductance of the inductor 34. Consequently the FET 26 has a relatively constant voltage gain, of the order of 10, over an operating bandwidth from d.c. to 1.5 MHz which is determined by the gain of the OTA 54.

As described in the introduction, in the common-source mode the FET 26 has an apparent gate capacitance Ca given by the equation Ca=Cgs+Cgd (1+A), where Cgs is the gate-source capacitance, Cgd is the gate-drain capacitance, and A is the voltage gain of the FET, resulting in an apparent gate capacitance of typically about 22 nF. The FET 26 also has a parasitic gate resistance, typically about 7.5 Ω, which is negligible compared with the output impedance of the OTA 54, which is typically about 3.3 kΩ. Consequently the FET 26 behaves as an ideal integrator, its apparent gate capacitance being charged by the current source constituted by the OTA 54, with −6 dB per octave slope and a constant −90° phase shift, and negligible excess or additional phase shift at frequencies up to 30 to 40 MHz.

The use of the OTA 54, which has no negative feedback, as a broadband current source to drive the gate of the FET 26 results in this integrator becoming the dominant pole in the control loop, by a large margin. The elimination of other poles in the control loop ensures that the voltage regulator has the desired wide bandwidth and good tracking ability for input transients. This pole, formed by the FET apparent gate capacitance and the current source constituted by the output of the OTA 54, has a corner frequency determined by the voltage gains of the FET 26 and the OTA 54, the gain of the OTA being determined by the resistance of the resistor 56 constituting the transconductance element of the OTA, which thereby also determines the 1.5 MHz bandwidth of the control loop.

Similar considerations apply in respect of the positive voltage regulator 22, except that the P-channel FET (e.g. device type RFP30P05) has a higher gate capacitance (typically about 40 nF) due to the structure of the FET. Consequently a smaller resistance (e.g. 162 Ω) is used for the resistor constituting the transconductance element to maintain substantially the same voltage gain of the OTA. For the MAX436 device the voltage gain Av is given by the equation Av=8* Zl/Zt, where Zl is the load impedance constituted by the capacitive impedance of the gate of the FET, and Zt is the impedance of the transconductance element.

It should be appreciated that the voltage regulators 22 and 24 described above provide good regulation over the desired relatively large control loop bandwidth of 1.5 MHz, while also providing a low regulating voltage drop. Even larger control loop bandwidths can easily be provided, if desired, by increasing the gain of the OTA. In addition, the regulators do not require separate higher voltage supplies or the use of voltage multipliers for driving the gates of the FETs.

Although the voltage regulators 22 and 24 as described above each use an OTA, it should be appreciated that other forms of transconductance amplifier (i.e. an amplifier producing a current drive output in response to a voltage input, or a voltage-controlled current source) can be used in a similar manner to operate as an integrator with the apparent gate capacitance of the regulating FET. In this respect it is observed that an operational amplifier can be used together with feedback resistances to emulate a voltage-controlled current source in known manner; however, such an arrangement is less desirable because the feedback provided by the resistances introduces a further pole into the control loop. In order to provide the desired wide bandwidth and stability, such an arrangement requires the use of a very fast, and consequently expensive, operational amplifier, in contrast to using a true transconductance amplifier as described above.

In addition, although the regulators described above each include a current limiter, a time switch associated with the input LC circuit, and a turn-on control circuit, the invention is equally applicable to voltage regulators without one or more of these functions.

Thus although particular embodiments of the invention have been described above, it should be appreciated that numerous modifications, variations, and adaptations may be made without departing from the scope of the invention as defined in the claims.

What is claimed is:

1. A voltage regulator comprising a FET having a source coupled to an input terminal for a voltage to be regulated, a drain coupled to an output terminal for a regulated output voltage, and a gate, a linear transconductance amplifier responsive to the output voltage for supplying a current drive to the gate of the FET, a current-sensing resistor in series with the source-drain path of the FET between the input and output terminals, and a current limiting circuit responsive to an excessive current flow through the current-sensing resistor for reducing current drive from the transconductance amplifier to the gate of the FET.

2. A voltage regulator as claimed in claim 1 and including a potential divider coupled to the output terminal, wherein the transconductance amplifier has differential inputs coupled to a tapping point of the potential divider and to a reference voltage.

3. A voltage regulator as claimed in claim 1 and including an inductor, via which the source of the FET is coupled to the input terminal, and a capacitor coupled between the source of the FET and ground.

4. A voltage regulator as claimed in claim 1 and including an inductor, via which the drain of the FET is coupled to the output terminal, and a capacitor coupled between the output terminal and ground.

5. A voltage regulator as claimed in claim 1 and including a turn-on control circuit responsive to initial supply of voltage to the input terminal for reducing current drive from the transconductance amplifier to the gate of the FET.

6. A voltage regulator comprising:

an input terminal for receiving an input voltage to be regulated;

an output terminal for delivering a regulated output voltage;

a current-sensing resistor;

a FET having a source coupled to the input terminal, a drain coupled via the current-sensing resistor to the output terminal, and a gate;

a linear transconductance amplifier having differential input terminals responsive to the output voltage and a reference voltage and an output coupled to the gate of the FET for supplying current thereto; and a current limiting circuit responsive to an excessive current flow through the current-sensing resistor for reducing current drive from the linear transconductance amplifier to the gate of the FET.

7. A voltage regulator as claimed in claim 6 and including an input low-pass filter comprising a series inductor, via which the source of the FET is coupled to the input terminal, and a shunt capacitor.

8. A voltage regulator as claimed in claim 7 and including an output low-pass filter comprising a series inductor, via which the drain of the FET is coupled to the output terminal, and a shunt capacitor.

9. A voltage regulator as claimed in claim 8 wherein the inductor of the output low-pass filter has a greater inductance than the inductor of the input low-pass filter.

10. A voltage regulator as claimed in claim 7 and including a turn-on control circuit responsive to initial supply of voltage to the input terminal for reducing current drive from the transconductance amplifier to the gate of the FET.

11. A voltage regulator as claimed in claim 6 and including a potential divider coupled to the output terminal, wherein the differential inputs of the transconductance amplifier comprise a non-inverting input coupled to a tapping point of the potential divider and an inverting input coupled to a reference voltage.

12. An electronic circuit card including two voltage regulators arranged to supply respectively positive and negative regulated voltages to electronic circuits on the circuit card, each voltage regulator comprising a FET having a source coupled to an input terminal for a voltage to be regulated, a drain coupled to an output terminal for a regulated output voltage, and a gate, a linear transconductance amplifier responsive to the output voltage for supplying a current drive to the gate of the FET, a current-sensing resistor in series with the source-drain path of the FET between the input and output terminals, and a current limiting circuit responsive to an excessive current flow through the current-sensing resistor for reducing current drive from the transconductance amplifier to the gate of the FET.

13. An electronic circuit card including two voltage regulators arranged to supply respectively positive and negative regulated voltages to electronic circuits on the circuit card, each voltage regulator comprising:

an input terminal for receiving an input voltage to be regulated;

an output terminal for delivering a regulated output voltage;

a current-sensing resistor;

a FET having a source coupled to the input terminal, a drain coupled via the current-sensing resistor to the output terminal, and a gate;

a linear transconductance amplifier having differential input terminals responsive to the output voltage and a reference voltage and an output coupled to the gate of the FET for supplying current thereto; and a current limiting circuit responsive to an excessive current flow through the current-sensing resistor for reducing current drive from the linear transconductance amplifier to the gate of the FET.

* * * * *